US008400391B2

(12) United States Patent
Schmidt et al.

(10) Patent No.: US 8,400,391 B2
(45) Date of Patent: Mar. 19, 2013

(54) METHOD AND SYSTEM FOR IMPROVING DIMMING PERFORMANCE IN A FIELD SEQUENTIAL COLOR DISPLAY DEVICE

(75) Inventors: John Schmidt, Phoenix, AZ (US); Kalluri R. Sarma, Mesa, AZ (US); Dennis M. Davey, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 737 days.

(21) Appl. No.: 11/972,199

(22) Filed: Jan. 10, 2008

(65) Prior Publication Data

US 2009/0179848 A1 Jul. 16, 2009

(51) Int. Cl.
*G09G 3/36* (2006.01)

(52) U.S. Cl. ..... 345/102

(58) Field of Classification Search ..... 345/88, 345/89, 102, 87, 90–101; 348/739
See application file for complete search history.

(56) References Cited

U.S. PATENT DOCUMENTS

| | | | | |
|---|---|---|---|---|
| 7,046,221 | B1 | 5/2006 | Malzbender | |
| 7,176,948 | B2 | 2/2007 | Lewis | |
| 7,268,765 | B2 | 9/2007 | Lim et al. | |
| 7,486,304 | B2 * | 2/2009 | Bergquist et al. | 345/690 |
| 2003/0058210 | A1 * | 3/2003 | Yamazaki et al. | 345/89 |
| 2004/0001076 | A1 | 1/2004 | Leng et al. | |
| 2005/0007306 | A1 | 1/2005 | Ilsaka et al. | |
| 2005/0017994 | A1 | 1/2005 | Oh | |
| 2006/0187181 | A1 | 8/2006 | Kim | |
| 2007/0013626 | A1 * | 1/2007 | Ando et al. | 345/88 |
| 2007/0176883 | A1 | 8/2007 | Hsu et al. | |
| 2007/0182699 | A1 | 8/2007 | Ha et al. | |
| 2008/0122832 | A1 * | 5/2008 | Chen et al. | 345/214 |
| 2009/0147154 | A1 * | 6/2009 | Arai et al. | 348/750 |

OTHER PUBLICATIONS

Japanese Office Action for application No. 2008-288932 dated Nov. 16, 2012.

* cited by examiner

*Primary Examiner* — Chanh Nguyen
*Assistant Examiner* — Pegeman Karimi
(74) *Attorney, Agent, or Firm* — Ingrassia Fisher & Lorenz, P.C.

(57) ABSTRACT

Methods and systems for displaying an image on a display device having first and second light sources are provided. A video signal is provided to the display device. The video signal includes first and second video frames. Each video frame includes first and second sub-frames corresponding to the respective first and second light sources. The first light source is operated for a first duration during the first sub-frame of the first video frame. The first light source is operated for a second duration during the first sub-frame of the second video frame. The second duration is different from the first duration.

20 Claims, 13 Drawing Sheets

METHOD AND SYSTEM FOR IMPROVING DIMMING PERFORMANCE IN A FIELD SEQUENTIAL COLOR DISPLAY DEVICE

GOVERNMENT RIGHTS

This invention was made with Government support under Contract RFP06-121, awarded by the U.S. Display Consortium (USDC)-Military and Avionics Users Group (MAUG). The Government has certain rights in this invention.

TECHNICAL FIELD

The present invention generally relates to display devices, and more particularly relates to methods and systems for improving performance in field sequential color (FSC) display devices.

BACKGROUND

In recent years, liquid crystal displays (LCDs), and other flat panel display devices, have become increasingly popular as mechanisms for displaying information to operators of vehicles, such as aircraft. One of the reasons for this is that LCDs are capable of providing very bright and clear images that are easily seen by the user, even in high ambient light situations, such as daytime flight.

Conventional active matrix (AM) LCDs use spatial averaging of the pixels to generate full color from three different colors (e.g., red, green, and blue (RGB)) of light emitters, such as light emitting diodes (LEDs), along with an array of color filters. However, approximately two-thirds of the available backlight power is often absorbed by a color filter array which significantly impairs power efficiency. This loss of power efficiency leads to thermal management being a significant issue in conventional LCD displays for applications requiring high display luminance.

Recently, field sequential color (FSC) displays have been developed for use with various image sources, such as LCDs, cathode ray tubes (CRTs), liquid crystal on silicon (LCOS), and digital micro-mirrors (DMMs). FSC displays do not use color filters and yet generate full color by sequentially writing each pixel in the display in conjunction with sequentially switching RGB emitters in the backlight. Full color is generated at each pixel by temporally averaging the RGB emissions of each pixel. Because color filters are not required, the power consumption is greatly reduced, which often eliminates the need for active cooling of the display in high luminance applications. Additionally, display resolution is effectively tripled when compared with conventional LCDs, as full color may be generated at each individual pixel, rather than using multiple pixels in combination.

However, there still are several limitations to FSC displays. For one, FSC displays provide little or no dimming capability, which prevents FSC displays from being used in a myriad of military and avionics display applications where a dimming ratio of 2000:1, or more, is typically required. A second limitation of the current FSC displays is color instability over a wide range of operating temperatures. The light emitting components (e.g., LEDs) exhibit large color shifts over extended operating temperature ranges and drive conditions.

Accordingly, it is desirable to provide a method and system for improving performance in a FSC display device, such as improving dimming and color performance over a wide range of temperatures and drive conditions. Furthermore, other desirable features and characteristics of the present invention will become apparent from the subsequent detailed description of the invention and the appended claims, taken in conjunction with the accompanying drawings and this background of the invention.

BRIEF SUMMARY

A method for displaying an image on a display device having first and second light sources is provided. A video signal is provided to the display device. The video signal includes first and second video frames. Each video frame includes first and second sub-frames corresponding to the respective first and second light sources. The first light source is operated for a first duration during the first sub-frame of the first video frame. The first light source is operated for a second duration during the first sub-frame of the second video frame. The second duration is different from the first duration.

A method for displaying an image on a display device having first and second pluralities of light emitters and an imaging source is provided. A video signal is provided to the display device. The video signal includes first and second video frames. Each video frame includes first and second sub-frames corresponding to the respective first and second pluralities of light emitters. The first plurality of light emitters is operated for a first duration during the first sub-frame of the first video frame. The first plurality of light emitters is operated for a second duration during the first sub-frame of the second video frame. The second duration is different from the first duration. The second plurality of light emitters is operated for a third duration during the second sub-frame of the first video frame. The second plurality of light emitters is operated for a fourth duration during the second sub-frame of the second video frame. The fourth duration is different from the third duration. An image is generated with the light emitted from the first and second pluralities of light emitters during the respective first and second durations with the imaging device.

A display device system is provided. The display device system includes a backlight including first and second light emitters, an image source coupled to the backlight and configured to generate an image with light emitted from the first and second light emitters, and a controller coupled to the backlight and the image source. The controller is configured to provide a video signal to the backlight and the image source, the video signal comprising first and second video frames, each video frame comprising first and second sub-frames corresponding to the respective first and second light emitters of the backlight, operate the first light emitter for a first duration during the first sub-frame of the first video frame, and operate the first light emitter for a second duration during the first sub-frame of the second video frame, the second duration being different from the first duration.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, and brief summary or the following detailed description. It should also be noted that FIGS. 1-13 are merely illustrative and may not be drawn to scale.

FIG. 1 to FIG. 13 illustrate methods and systems for displaying an image on a display device having first and second light sources (e.g., multiple colors of light emitting diodes (LEDs)). A video signal is provided to the display device. The video signal includes first and second video frames. Each video frame includes first and second sub-frames corresponding to the respective first and second light sources. The first light source is operated for a first duration during the first sub-frame of the first video frame. The first light source is operated for a second duration during the first sub-frame of the second video frame. The second duration is different from the first duration. The difference in the durations allows for the luminance of the display device to be controlled to provide dimming (and/or brightening).

Exemplary embodiments of the invention also provide a display comprising a field sequential color (FSC) backlight coupled to a FSC liquid crystal display (LCD) module. The backlight system controller receives and processes brightness data for red, green, and blue light emitters, and video timing signals that synchronize FSC backlight operation with FSC LCD operation. Furthermore, the backlight system controller may be implemented using a plurality of digital controls, including field programmable gate arrays (FPGAs), application specific integrated circuits (ASICs), discrete logic, microprocessors, microcontrollers, and digital signal processors (DSPs), or combinations thereof.

Figure 1:
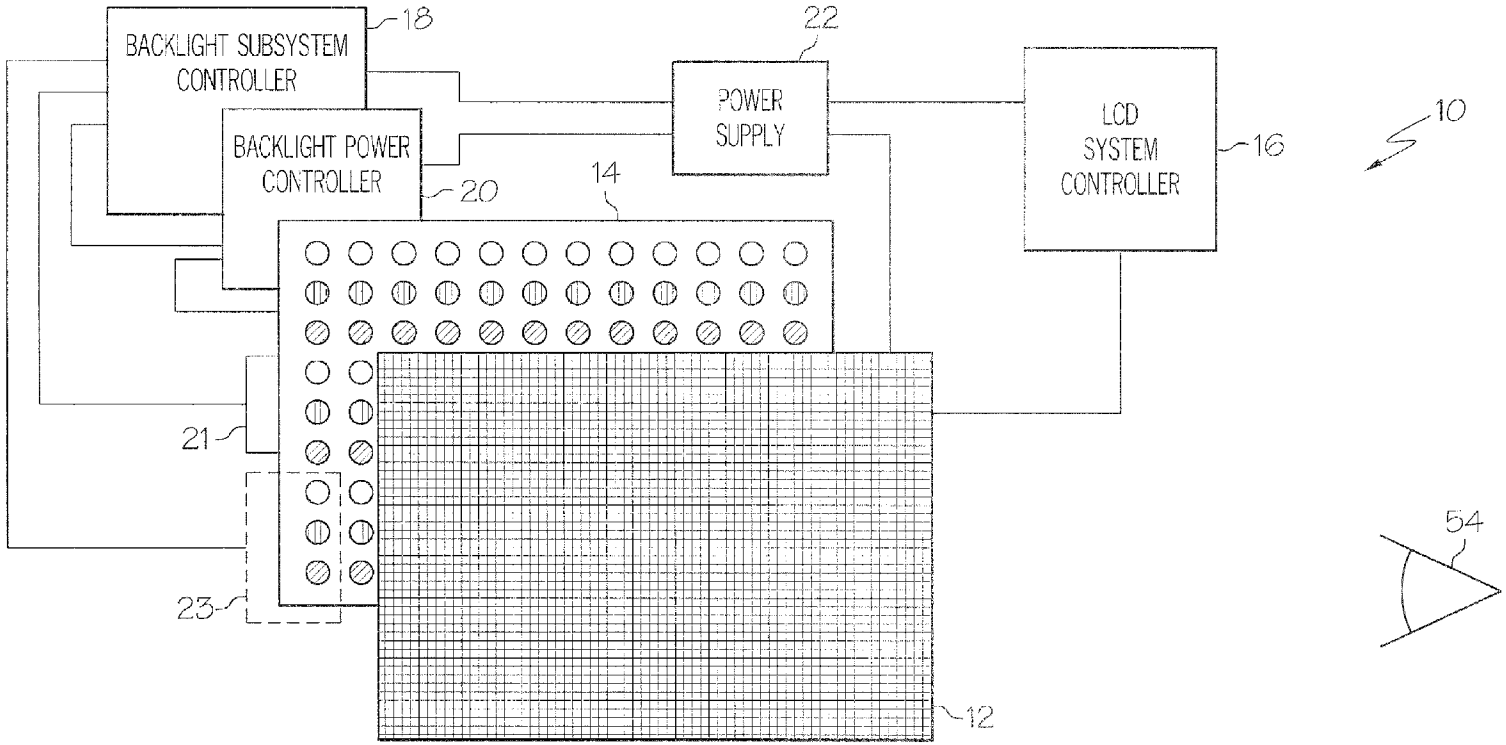
FIG. 1 is a schematic plan view of a field sequential color (FSC) display system according to one embodiment of the present invention.

FIG. 1 schematically illustrates a FSC display system 10, according to one embodiment of the present invention. The FSC system 10 includes a LCD panel 12, a FSC backlight 14, a LCD system controller 16, a backlight subsystem controller 18, a backlight power controller 20, and a power supply 22. In the embodiment shown in FIG. 1, the FSC system 10 also includes a temperature sensor 21 and a luminosity sensor 23.

Figure 2:
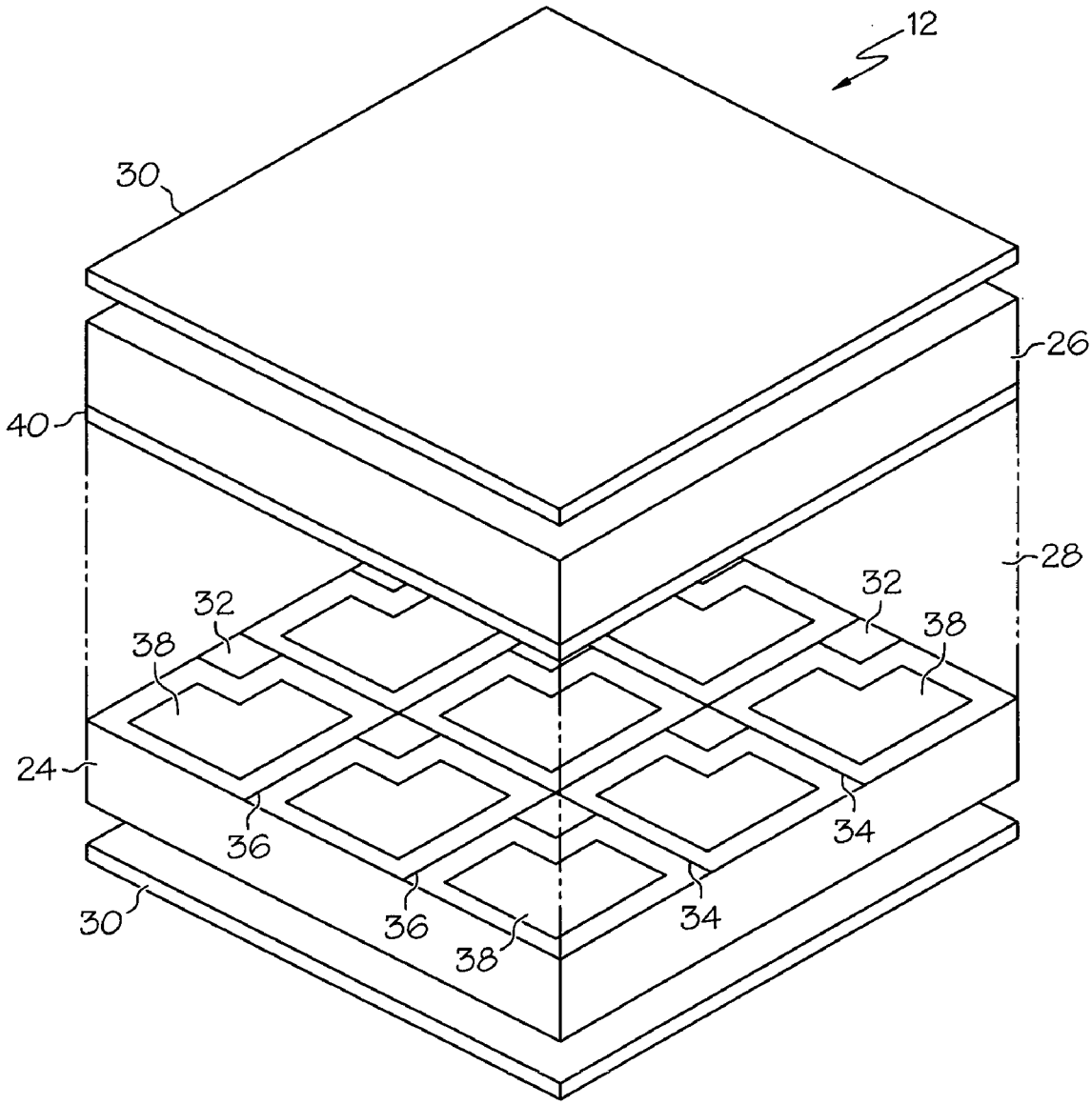
FIG. 2 is a cross-sectional isometric view of a portion of a LCD panel within the display system of FIG. 1.

The LCD panel 12 is in operable communication with the LCD system controller 16 and the power supply 22. FIG. 2 illustrates a portion of the LCD panel 12, according to one embodiment of the present invention. The LCD panel 12 is, in one embodiment, a thin film transistor (TFT) LCD panel and includes a lower substrate 24, an upper substrate 26, a liquid crystal layer 28, and polarizers 30. As will be appreciated by one skilled in the art, the lower substrate 24 may be made of glass and have a plurality of TFTs (thin film transistors) 32 formed thereon and a plurality of gate electrodes 34 (i.e., row lines) and source electrodes 36 (i.e., column lines) interconnecting respective rows and columns of the transistors 32. The gate and source electrodes 34 and 36 define the lower substrate 24 into a plurality of display pixels 38, as is commonly understood. The upper substrate 26 may also be made of glass and includes a common electrode 40 at a lower portion thereof. It should be noted that, at least in one embodiment, the LCD panel 12 does not include a color filter array layer. The common electrode 40 may substantially extend across the upper substrate 26. The liquid crystal layer 28 may be positioned between the lower substrate 24 and the upper substrate 26 and includes a liquid crystal material suitable for use in a FSC LCD display. As shown, the LCD panel 12 includes two polarizers 30, with one being positioned below the lower substrate 24 and one above the upper substrate 26. Although not illustrated, the polarizers 30 may be oriented such that the LCD panel operates in a normally white mode.

Figure 3:
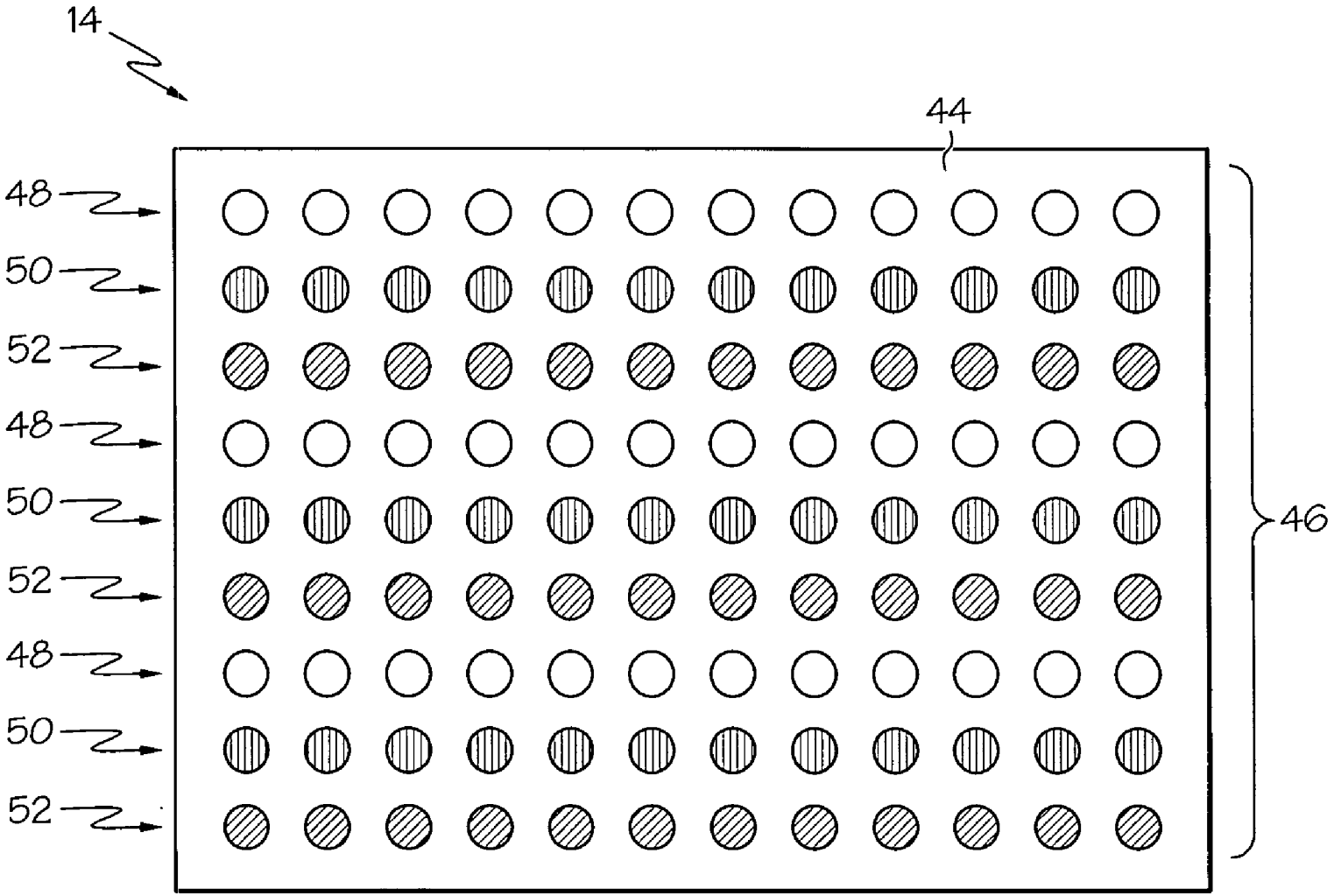
FIG. 3 is a plan view of a backlight within the display system of FIG. 1.

Referring again to FIG. 1, the backlight 14 is placed proximate to the LCD panel 12 and is in operable communication with the backlight power controller 20. FIG. 3 illustrates the backlight 14 in greater detail. In one embodiment, the backlight 14 is a light emitting diode (LED) panel that includes a support substrate 44 with an array of LEDs (e.g., RGB LEDs) 46 mounted thereto. The substrate support 44 may include a thermally conductive (e.g., made of copper) component that interconnects all of the LEDs 46 or multiple (e.g., three) sets of thermally and/or electrically conductive members that thermally and/or electrically interconnect the LEDs of each color.

In one embodiment, the LEDs 46 includes rows of red LEDs 48, rows of green LEDs 50, and rows of blue LEDs 52. Although the LEDs 46 shown in FIG. 3 are arranged in a 12×9 array, for a total of 108 LEDs, it should be understood that the backlight 14 may include fewer or considerably more LEDs, such as over 1000. As is commonly understood, the red LEDs 48 emitted red light with a frequency between (or in a frequency band), for example, 430 and 480 terahertz (THz). The green LEDs 50 emit light with a frequency between, for example, 540 and 610 THz. The blue LEDs 52 emit light with a frequency between, for example, 610 and 670 THz. It will be appreciated by one skilled in the art that the exact performance characteristics, or radiant properties, (e.g., frequency, brightness, emission angle, etc.) of the LEDs 46, and thus the backlight 14 as a whole, may vary depending on the manufacturer of the LEDs 46, as well as manufacturing variations experienced by a single manufacturer. These variations in performance characteristics, however, may be determined using techniques well known in the art (e.g., optical testing). The differences in the radiant properties of the LEDs may then be utilized in optimizing the performance of the display system as described below.

Referring again to FIG. 1, the LCD system controller 16, the backlight subsystem controller 18, the backlight power controller 20, and the power supply 22 are in operable communication and/or electrically connected as shown. In one embodiment, the controllers 16, 18, and 20 include electronic components, including various circuitry and/or integrated circuits, such as FPGAs, ASICs, discrete logic, microprocessors, microcontrollers, and DSPs, and/or instructions stored on a computer readable media to be carried out by the circuitry to individually or jointly perform the methods and processes described below. The LCD system controller 16, the backlight subsystem controller 18, and the backlight power controller 20 may thus jointly form a processing or control system. As will be appreciated by one skilled in the art, the temperature sensor 21 is arranged proximate the backlight 14 and configured to sense an operating temperature of the backlight 14. The operating temperature may be associated with the backlight 14 as a whole or one or more particular colors of the LEDs 46 on the backlight 14. The luminosity sensor 23 may be a photopic light (or color) sensor, as is commonly understood, configured to separately detect the brightness of each of the three colors of LEDs 46. The temperature sensor 21 and the luminosity sensor 23 are in operable communication with the backlight subsystem controller 18.

During operation, the LCD system controller 16 provides video data, or a video signal, to the LCD panel 12 in the form of color and brightness. In one embodiment, and in accordance with FSC display operation, the video data is applied in sequential frames (full or partial video frames), with each frame including multiple (e.g., three) sub-frames, each corresponding only to a particular color (e.g., red, green, or blue). For example, the first sub-frame includes only red data for each display pixel 38 (FIG. 2), the second sub-frame includes only green data for each display pixel 38, and the third sub-frame includes only blue data for each display pixel 38. The three sequentially applied video sub-frames are temporally averaged by a viewer's eye 54 to produce the proper mix of red, green, and blue for each displayed pixel 38 on the LCD panel 12.

The LCD system controller 16 provides a synchronization signal to the backlight subsystem controller 18 to ensure that the red video sub-frame provided by the LCD system controller 16 is synchronized with the activation of the red LEDs 48 (FIG. 3). In a similar fashion, the LCD system controller 16 provides synchronization signals to the backlight subsystem controller 18 to ensure that the green video sub-frame and the blue video sub-frame provided by the LCD system controller 16 are synchronized with the activation of the respective green LEDs 50 and blue LEDs 52.

Referring to FIG. 2, a time-varying voltage is applied across each pixel 38 that dictates the amount of movement (tilting, twisting, etc.) exhibited by the liquid crystal molecules located in the liquid crystal layer 28 to control the amount of light which passes through the LCD panel 12. As such, the LCD panel 12 modulates the light passing therethrough in such a way that information (e.g., in the form of images, text, symbols, etc.) is displayed to the viewer's eye 54.

The LCD system controller 16 provides an image synchronization signal to the backlight subsystem controller 18, which may occur at one-third of the sub-frame rate, at the sub-frame rate, or at an alternate rate which ensures synchronized operation between the LCD panel 12 and the backlight 14, depending upon the point of origin for the image synchronization signal. For example, if the sub-frame rate is 180 Hz, then the image synchronization signal may be provided at 60 Hz or 180 Hz.

Figure 4:
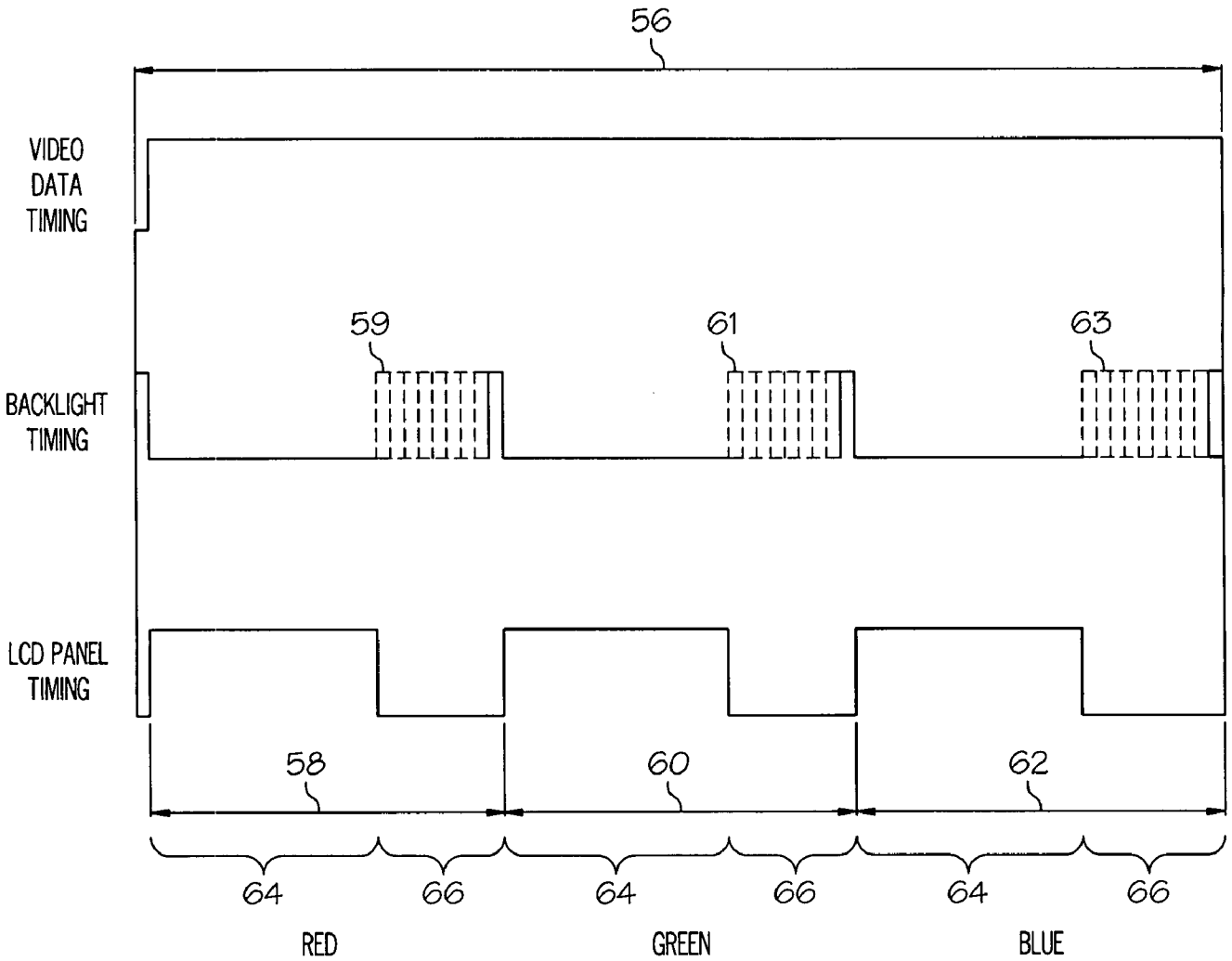
FIG. 4 is temporal view illustrating the operation of the display system of FIG. 1 during one video frame in accordance with one embodiment of the present invention.

FIG. 4 temporally illustrates operation of the backlight 14 in conjunction with the LCD panel 12, according to one embodiment of the present invention. Although only one frame is shown in FIG. 4, the operation is divided into video frames 56, each of which includes a red sub-frame 58, a green sub-frame 60, and a blue sub-frame 62. According to one aspect of the present invention, the sub-frames 58, 60, and 62 have adjustable "on-times" for the LEDs dependent on the desired brightness of the backlight 14, which may be controlled using pulse width modulation (PWM), as is commonly understood.

The duration for the frame 56 is equal to the sum of the durations of the sub-frames 58, 60, and 62 and may be similar to conventional frame times for FSC operation (e.g., 16.6667 ms for 60 Hz operation). As shown in FIG. 4, the sub-frames 58, 60, and 62 include inactive portions 64 and active portions 66. As will be appreciated by one skilled in the art, during the inactive portions 64, none of the LEDs 46 on the backlight 14 are operated while the gate and source electrodes 34 and 36 (FIG. 2) are configured (i.e., "written") to apply appropriate voltages to the pixels 38. During the active portions 66 of each of the sub-frames 58, 60, and 62, the respective color of LEDs 46 (e.g., red LEDs 48, green LEDs 50, or blue LEDs 52) are activated while the pixels 38 are appropriately configured to selectively block the light emitted by the LEDs 46.

Thus, within a single video frame 56, the operation of the backlight 14 and the LCD panel 12 includes configuring the pixels 38 three times (i.e., once for each of the colors of LEDs) and emitting light through the LCD panel 12 three times (i.e., each of the colors of LEDs being activated once). During the red sub-frame 58, the pixels 38 are appropriately configured for red light within the inactive portion 64, and the red LEDs 48 are operated within the active portion 66. During the green sub-frame 60, the pixels 38 are appropriately reconfigured for green light within the inactive portion 64, and the green LEDs 50 are operated within the active portion 66. During the blue sub-frame 62, the pixels 38 are again appropriately reconfigured for blue light within the inactive portion 64, and the blue LEDs 52 are operated within the active portion 66.

Still referring to FIG. 4, pulse width modulation is applied to the video signal to effect a change in the backlight's luminance by adjusting the active portions 66 (or "on-times") for the LEDs) of the sub-frames 58, 60, and 62, as indicated by dashed lines shown on pulses, or "pulse widths," 59, 61, and 63, which indicate the on-times for the respective LEDs. As the on-time, or pulse width, of the red LEDs is increased, the inactive portion 64 (or the duration thereof) of sub-frame 58 (or vblankDelay) decreases. Likewise, as the pulse width of the red LEDs decreases, the inactive portion 64 of sub-frame 58 increases to offset the decreased red pulse width. In a similar fashion, as the active portion 66 of sub-frame 60 (or the green pulse width) increases, the inactive portion 64 of sub-frame 60 (or rgDelay) decreases. As the green pulse width decreases, the inactive portion 64 of sub-frame 60 increases. The same is true for the blue LEDs, as when the blue pulse width (or the active portion 66 of sub-frame 62) is increased, the inactive portion 64 of sub-frame 62 (or gbDelay) decreases, and when the pulse width of blue decreases, the inactive portion 64 of sub-frame 62 increases to offset the decreased blue pulse width. In one embodiment, the minimum possible pulse width for each of the LED colors may be approximately 10 percent of the maximum possible pulse width.

Figure 5:
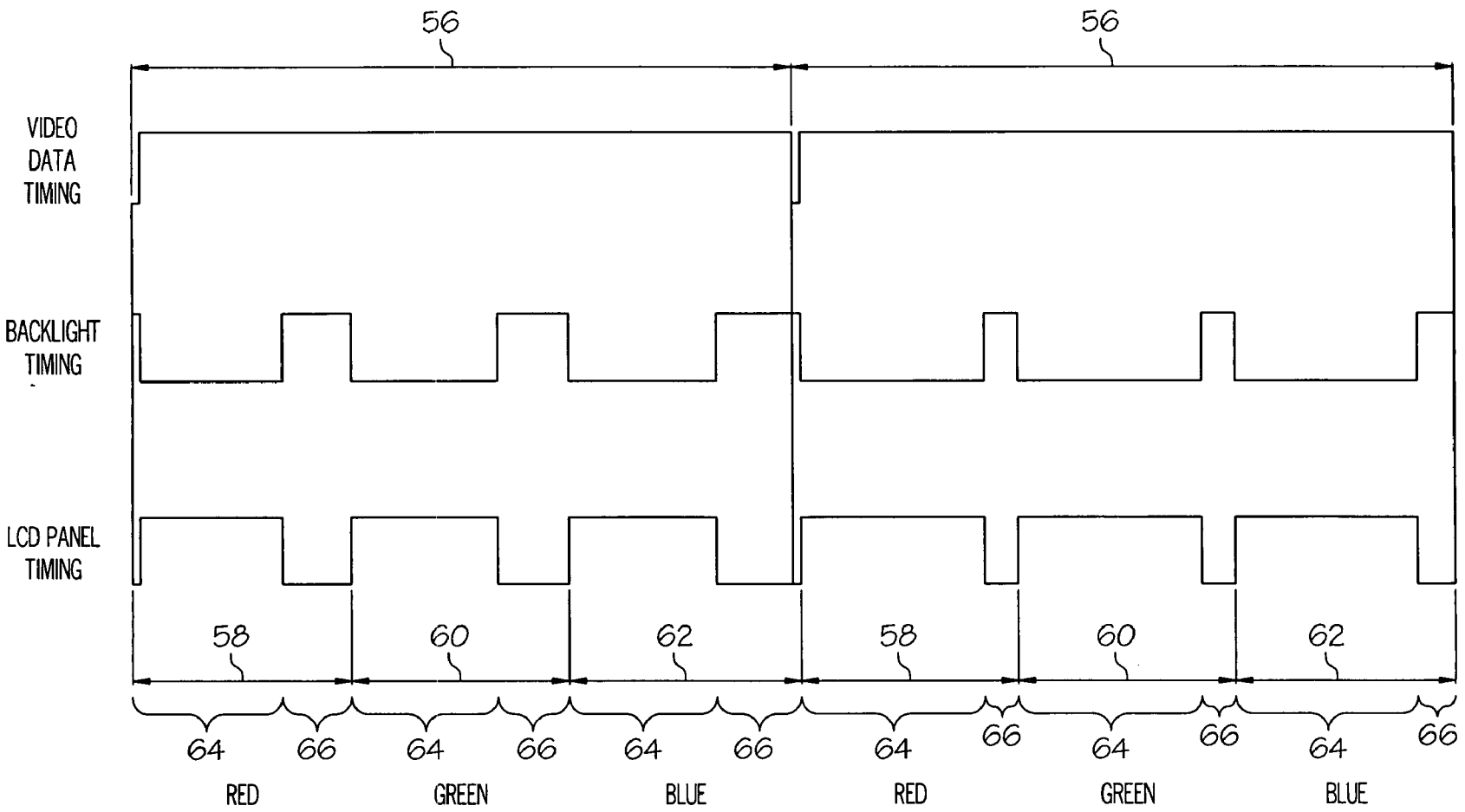
FIG. 5 is a temporal view illustrating the operation of the display system of FIG. 1 during consecutive video frames.

FIG. 5 illustrates two successive video frames 56 using the pulse width modulation adjustments described above. As shown, the pulse widths, or on-times, for the red, green, and blue LEDs are greater in the first video frame 56 (on the left) than in the second video frame 56 (on the right). More particularly, operating time for the red LEDs is changed from a first duration in the first frame 56 to a second duration in the second frame 56. The operating time for the green LEDs is changed from a third duration in the first frame to a fourth duration in the second frame. The operating time for the blue LEDs is changed from a fifth duration in the first frame to a six duration in the second frame. In the embodiment shown in FIG. 5, the first, third, and fifth durations are equal, and the second, fourth, and six durations are equal.

As a result, the total amount of time that the LEDs are operated is reduced, which results in a decrease in the amount of light emitted by the LEDs. Thus, the brightness of the LCD system 10 (FIG. 1) is reduced.

Figure 6:
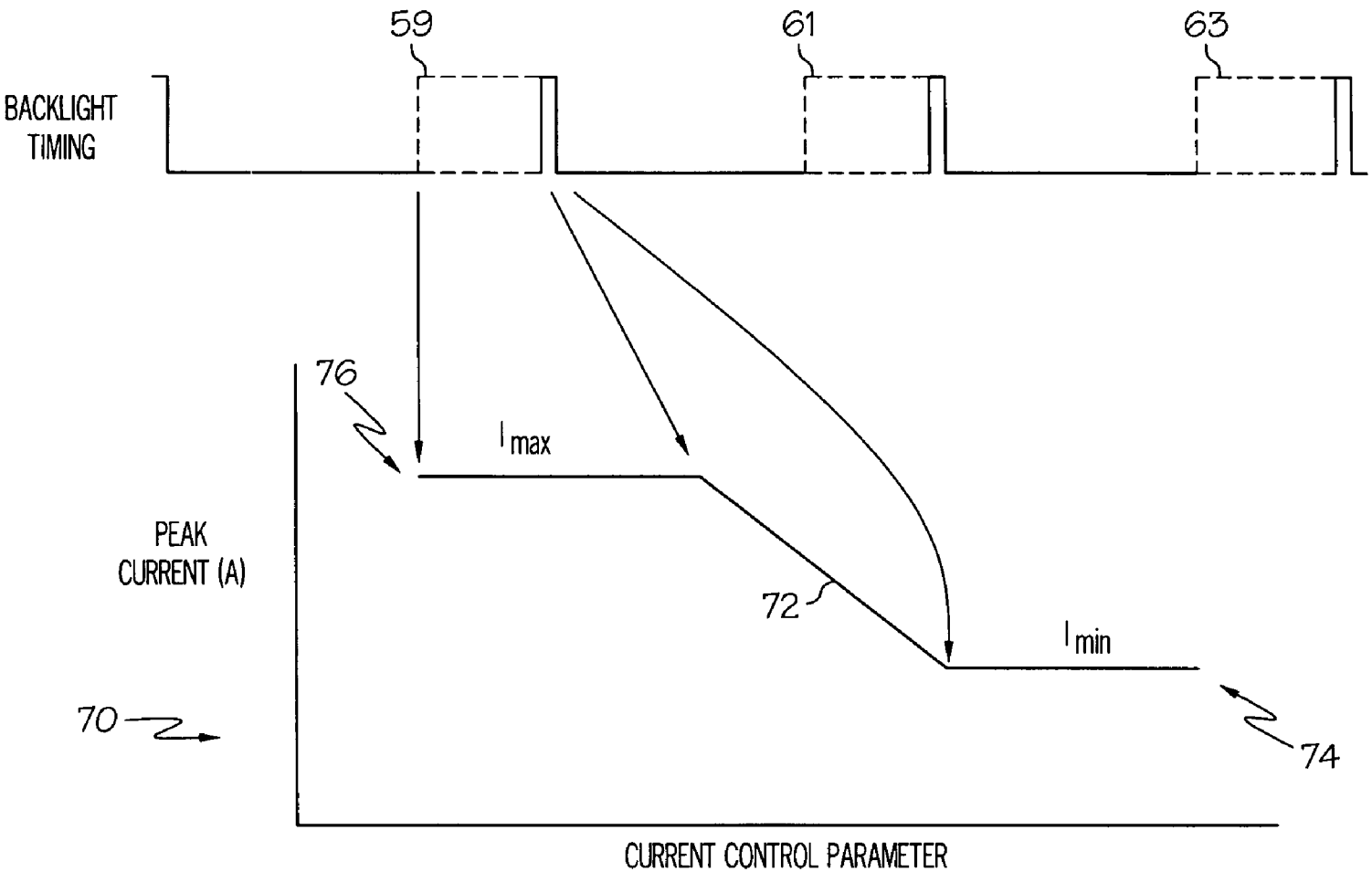
FIG. 6 graphically illustrates a peak current control method used in combination with operation of the display system similar to that shown in FIG. 4.

In one embodiment, the pulse width adjustments described above are used to adjust the brightness of the backlight 14 when operating at relatively high power levels. When the minimum pulse width of red, green, or blue has been reached, additional dimming within the lower brightness control range may be provided through the peak current control as shown in FIG. 6, which illustrates the relationship between the minimum red pulse width and a current programming value, or graph, 70. In the example shown, once the minimum red pulse width has been achieved, additional dimming capability is provided by programming the peak emitter current to decreasing values as indicated by sloped portion 72 of graph 70. The peak current may be lowered until the lower operating current limit 74 ($I_{min}$) has been reached. Within the upper brightness control range, or when the pulse width is above the minimum pulse width, the peak current is set to a fixed maximum value 76 ($I_{max}$). The maximum and minimum permissible current values may vary based on the particular display system 10, as is commonly understood. Although FIG. 5 specifically illustrates the lower brightness control range for the red pulse width or LEDs, it should be understood that similar control schemes are applied to the green and blue LEDs as well.

Figure 7:
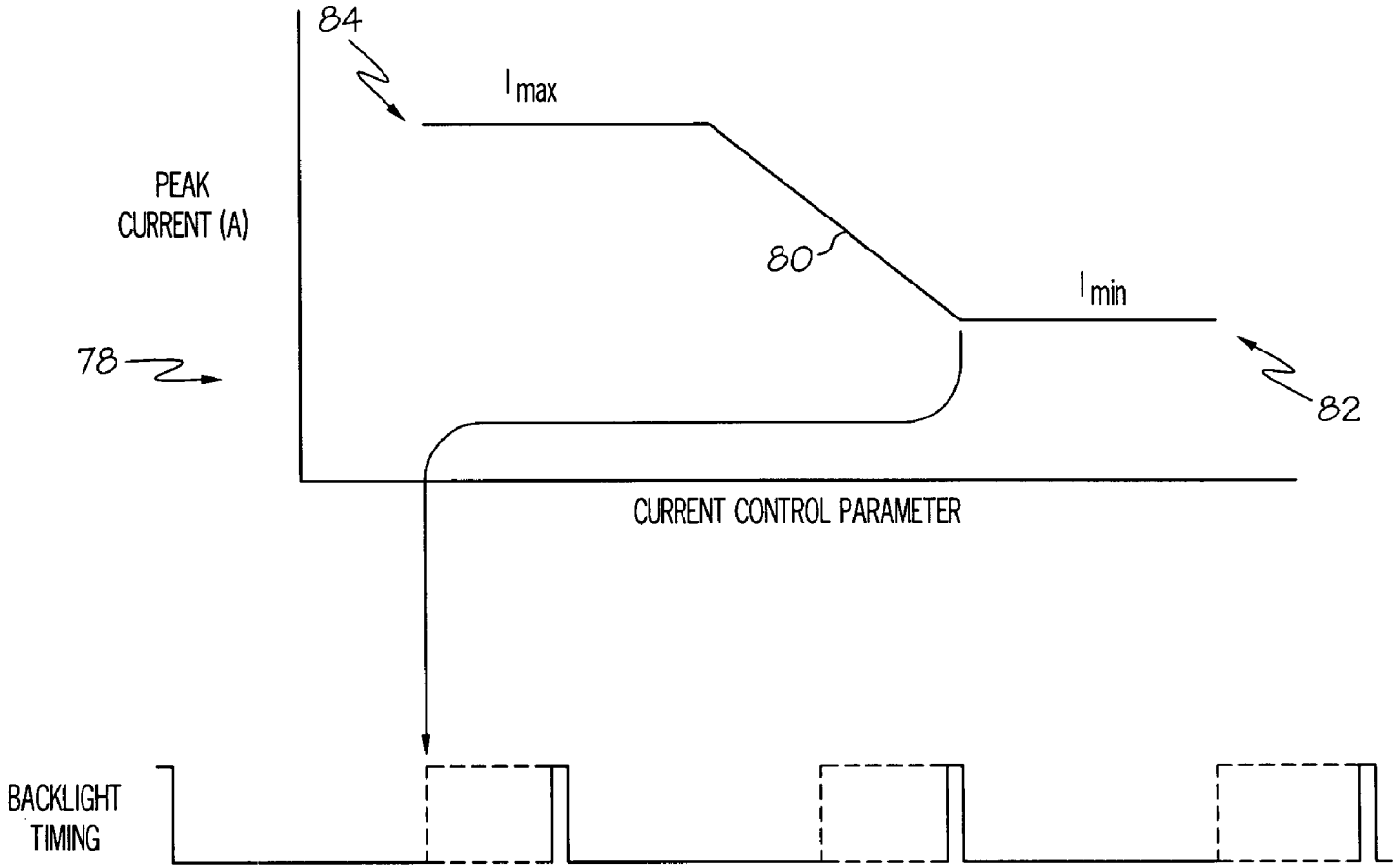
FIG. 7 graphically illustrates a peak current control method used in combination with operation of the display system similar to that shown in FIG. 4, according a different embodiment.

As indicated in FIG. 7, in another embodiment, the upper dimming range is controlled by a current programming graph 78, similar to that shown in FIG. 5, and the lower dimming range is controlled by pulse width modulation adjustments as described above. The peak current may be lowered on a sloped portion 80 to a lower operating current limit 82 ($I_{min}$) after beginning at a fixed maximum value 84 ($I_{max}$). As shown, after the current is reduced to the lower limit 82, the pulse width modulation adjustments are used, starting with the pulse widths at their maximums.

It should be understood that the peak operating current and pulse widths may be programmed to an infinite number of combinations and profiles based on specific system requirements. For example, while one exemplary embodiment illustrates pulse width being adjusted to a minimum value before the peak current profile is altered, it is possible to set the peak current to any acceptable system value for any given setting of the pulse width. Likewise, the exemplary embodiment which adjusts the peak current to a minimum value before altering the pulse width could have set the pulse width to any arbitrary value with currents above the minimum limit.

It should also be understood that the temperature sensor 21 and the luminosity sensor 23 may be used to make adjustments to the dimming scheme described above. For example, the performance characteristics of the LEDs 46 may be dependent on the operating temperature(s) of the backlight 14 and/or the "age" (or usage) of the LEDs 46. Uncompensated LED backlight units often exhibit uncontrolled color shifts over the display operating temperature range, and over the backlight unit's full scale dimming range. This undesirable characteristic is caused by the LEDs characteristic performance curves. The LED colors exhibit unique brightness versus drive current performance curves, and brightness versus die temperature performance curves, and it is desirable and beneficial to compensate for these characteristics. Using the LED manufacturer's data sheets, it is possible to program the characteristic operating information into the backlight control system and compensate the backlight operation as a function of brightness and temperature.

In one embodiment, temperature compensation is provided using a polynomial curve fit. Each color of LED's brightness versus temperature is plotted. From this plot, a polynomial curve fit is applied, and the polynomial equation is programmed into the backlight control system. The sensed backlight temperature is used to calculate the LEDs temperature performance, and compensate the LED's drive current according to the stored polynomial equation. In a similar fashion, the LED's brightness versus drive current may be defined with an appropriate curve fit using polynomials of arbitrary order, or with exponential functions. This mathematical relationship between drive current and brightness is programmed into the backlight control unit's processing algorithm, which compensates each LEDs drive current based on backlight temperature and backlight brightness. As such, embodiments of the present invention provide compensation to each LED color. The color compensation may stabilize the display's color performance over the full range of display operating temperatures, and over the full dimming range.

Figure 8:
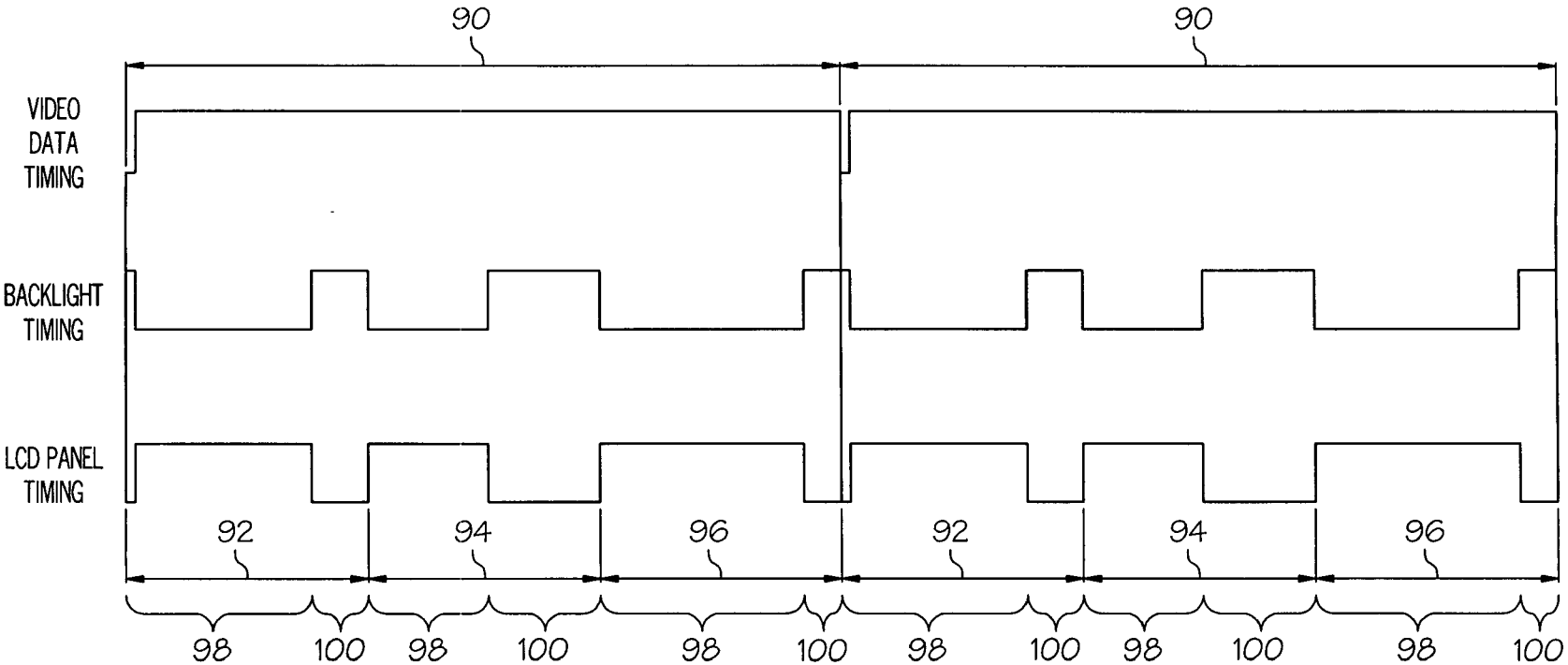
FIG. 8 is a temporal view illustrating the operation of the display system of FIG. 1 during consecutive video frames in which asymmetric LED on-times are used.

FIG. 8 illustrates two pairs of successive video frames 90, according to another embodiment of the present invention, utilizing asymmetric pulse widths. In a fashion similar to the video frames 56 described above, the video frames 90 each include three sub-frames 92, 94, and 96 that correspond to the red, green, and blue LEDs, respectively. Each of the sub-frames 92, 94, and 96 includes an inactive portion 98 and an active portion 100, similar to those described above. However, in the embodiment shown in FIG. 8, the active portions 100 of the sub-frames 92, 94, and 96 differ considerably. That is, although the time taken to configure the pixels 38 is approximately the same in each sub-frame 58, 60, and 62, the "on-time" for each color is unique. The on-times for each color may be are optimized based on the required luminance from each of the colors and the relative performance characteristics (i.e., differences in radiant properties) of the individual emitters as described above, as well as perception of the different colors of light by the viewer's eye 54.

Still referring to FIG. 8, the pulse widths, or on-times, for the red, green, and blue LEDs are greater in the first video frame 90 (on the left) than in the second video frame 90 (on the right), while retaining the asymmetry of the pulse widths of the LEDs. As a result, the total amount of time that the LEDs are operated is reduced, which results in a decrease in the amount of light emitted by the LEDs. Thus, the brightness of the display system 10 (FIG. 1) is reduced, while maintaining the performance benefits of the asymmetric pulse widths.

The on-times for each color (and thus the sub-frame durations) may be optimized based on the required luminance from each of the colors and the relative performance characteristics (i.e., differences in radiant properties) of the individual emitters as described above, as well as perception of the different colors of light by the viewer's eye 54. For example, when the blue luminance requirement is low, the blue LEDs 52 backlight duty cycle, and thus the blue sub-frame 62 time, is decreased in relation to the green sub-frame 60 time and the red sub-frame 58 time. Increasing the on-times for the green and red LEDs 48 and 50 by increasing their duty cycle (and thus increasing their sub-frame times) increases the display luminance for those colors.

One advantage of the method and system described above is the dimming range of FSC displays is greatly improved and may exceed 2000:1. Another advantage is that color uniformity and gray-level luminance in FSC displays is improved.

Figure 9:
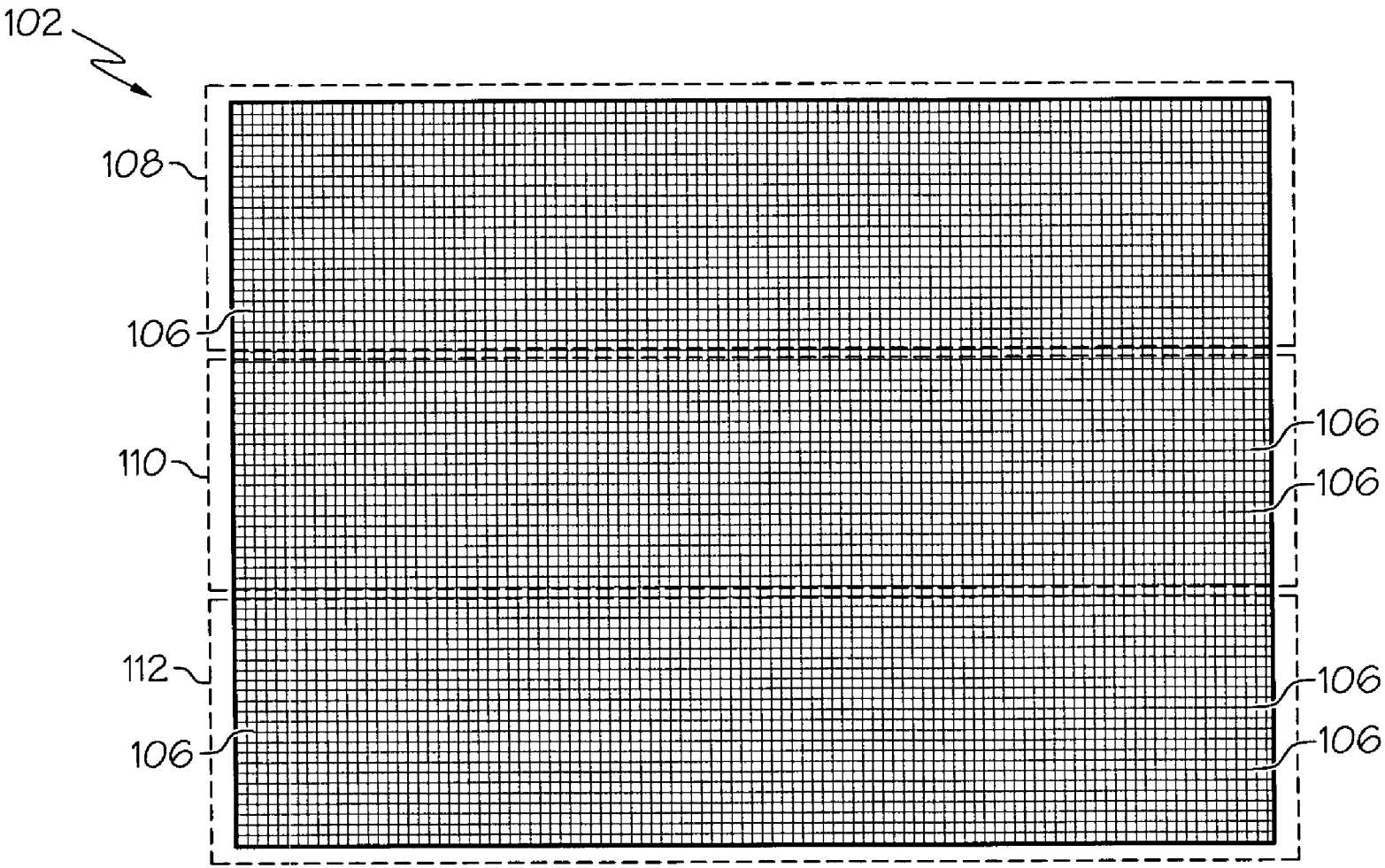
FIG. 9 is a plan view of a liquid crystal display (LCD) panel according to another embodiment of the present invention.
Figure 10:
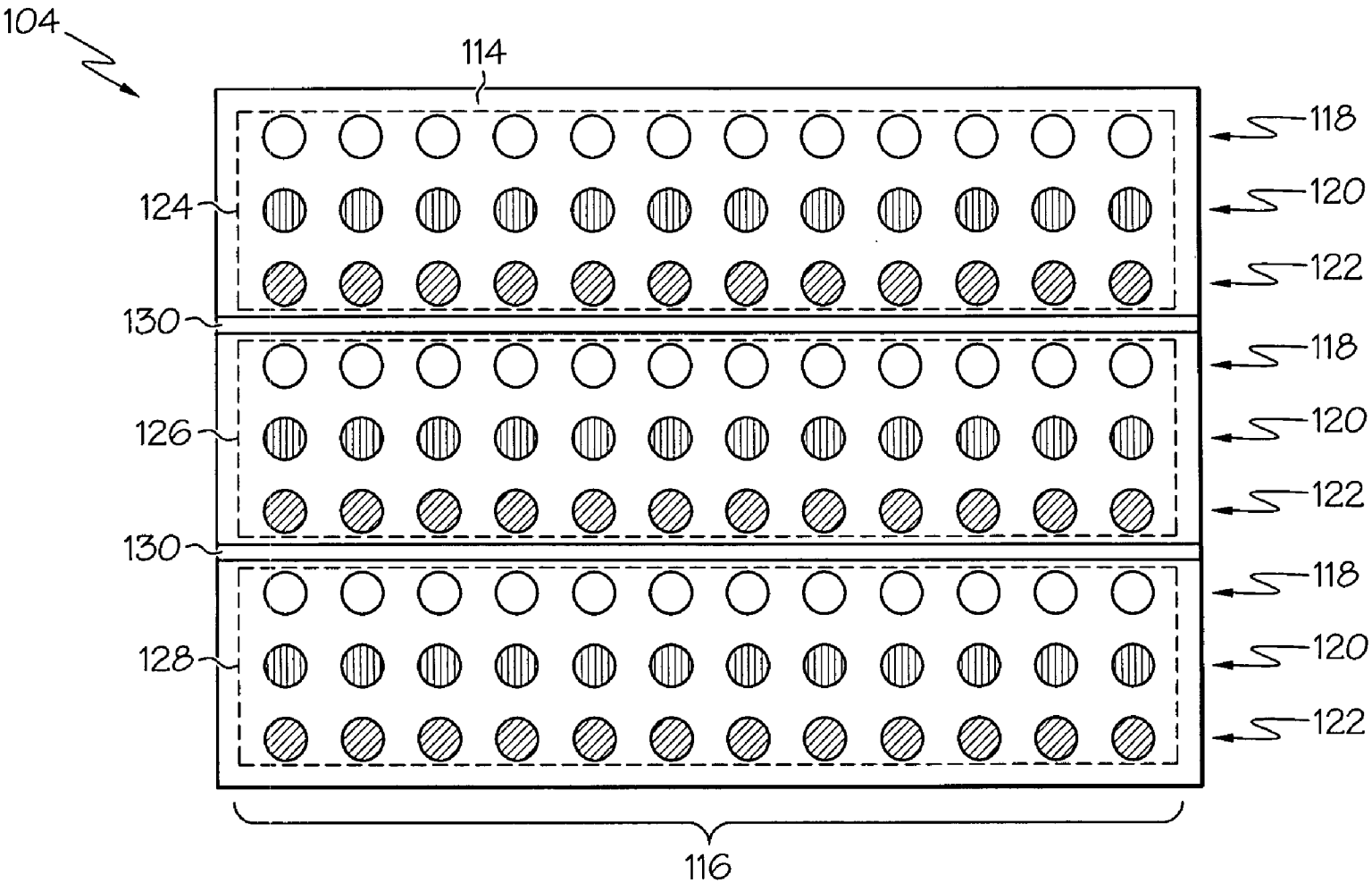
FIG. 10 is a plan view of a backlight for use in conjunction with the LCD panel of FIG. 9.

FIGS. 9 and 10 illustrate a LCD panel 102 and a backlight 104 according to another embodiment of the present invention. The embodiment shown in FIGS. 9 and 10 uses multiple, independently controllable backlight zones in conjunction with the asymmetric sub-frame time mode of operation. The backlight zones are arranged perpendicular to the row scan direction (i.e., parallel to the gate lines 34 in the LCD panel 12 in FIG. 2). With multiple backlight zones, the RGB backlight behind the first zone can be turned "on" soon after the corresponding display region has been addressed and the LCD pixels have responded, without having to wait until the entire display has been addressed and has responded. As a result, the duty cycles of the RGB emitters may be increased, which further increases display luminance.

Referring now to FIG. 9, the LCD panel 102 may be similar to that shown in FIGS. 1 and 2 and similarly includes a plurality of pixels 106. However, the pixels 106 are divided into an upper (or first) section (or zone) 108, a mid-section (or second section) 110, and a lower (or third) section 112. In one embodiment, the LCD panel 102 is scanned from top to bottom, just as in a conventional LCD. The predetermined number of multiple zones, or sections 108, 110, and 112, are defined by time boundaries during the scanning process. At these time boundaries for each zone, backlight operation is adjusted to maintain color synchronization with the applied LCD data.

As shown in FIG. 10, the backlight 104 may be similar to that shown in FIG. 3 and include a substrate 114 and a LED array 116 on the substrate 114 and arranged in red LED rows 118, green LED rows 120, and blue LED rows 122. Similar to the sections 108, 110, and 112 in FIG. 9, the LEDs 116 are divided into an upper group 124, a mid-group 126, and a lower group 128, each of which is activated separately, as described below. The backlight 104 also includes dividers 130 to block light from the LEDs 116 from crossing the boundaries of the groups 124, 126, and 128.

During operation the LCD panel 102 and the backlight 104 are arranged such that the upper, mid-, and lower sections 108, 110, and 112 of the LCD panel 102 are aligned with the respective upper, mid-, and lower groups 124, 126, and 128 of the backlight 104. The LCD panel 102 and the backlight 104 may be driven using similar signal to those depicted in FIG. 4. However, the illumination of the pixels 106 in the upper section 108 of the LCD panel 102 occurs before the illumination of the pixels 106 in the mid- and lower sections 110 and 112. That is, in the red sub-frame 58 (FIG. 4), once the pixels 106 in the upper section 108 of the LCD panel 102 have been written and configured (i.e., after the inactive portion 64 of the red sub-frame 58), the red LEDs 118 in the upper group 124 of the backlight 104 are activated (i.e., the active portion 66 of the red sub-frame 58). During the activation of the red LEDs 118 in the upper group 124, the pixels 106 in the mid-section 110 of the LCD panel 102 are written and configured. After the pixels 106 in the mid-section 110 of the LCD panel 102 are configured, the red LEDs 118 in the mid-group 126 of the backlight 104 are activated.

Of particular interest in this embodiment is that the upper section 108 of the LCD panel 102 and the upper group 124 of the backlight 104 continue to carry out the operation as dictated by the green and blue sub-frames 60 and 62 while the other sections and groups are still operating under the red sub-frame 58.

Figure 11:
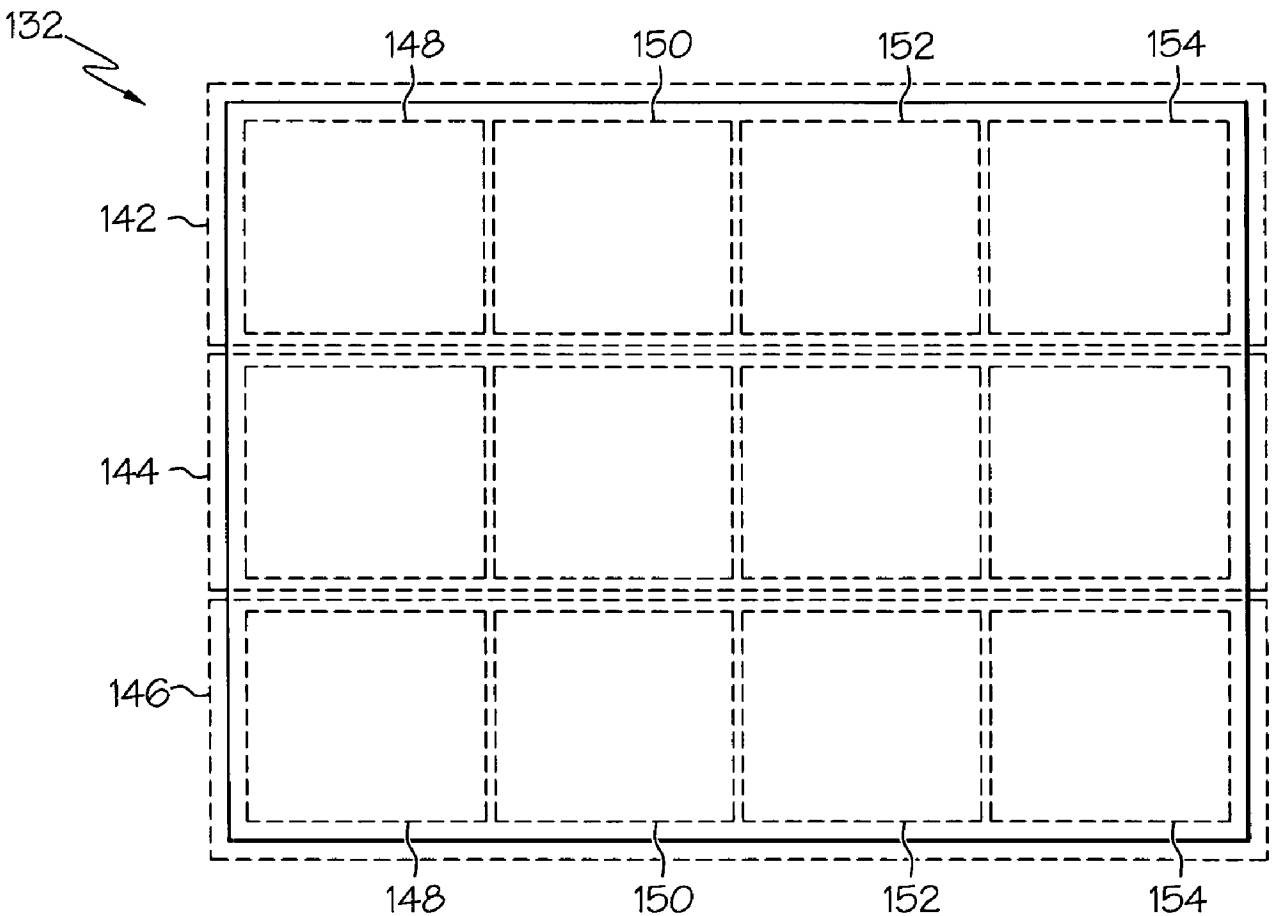
FIG. 11 is a plan view of a LCD panel according to a further embodiment of the present invention.
Figure 12:
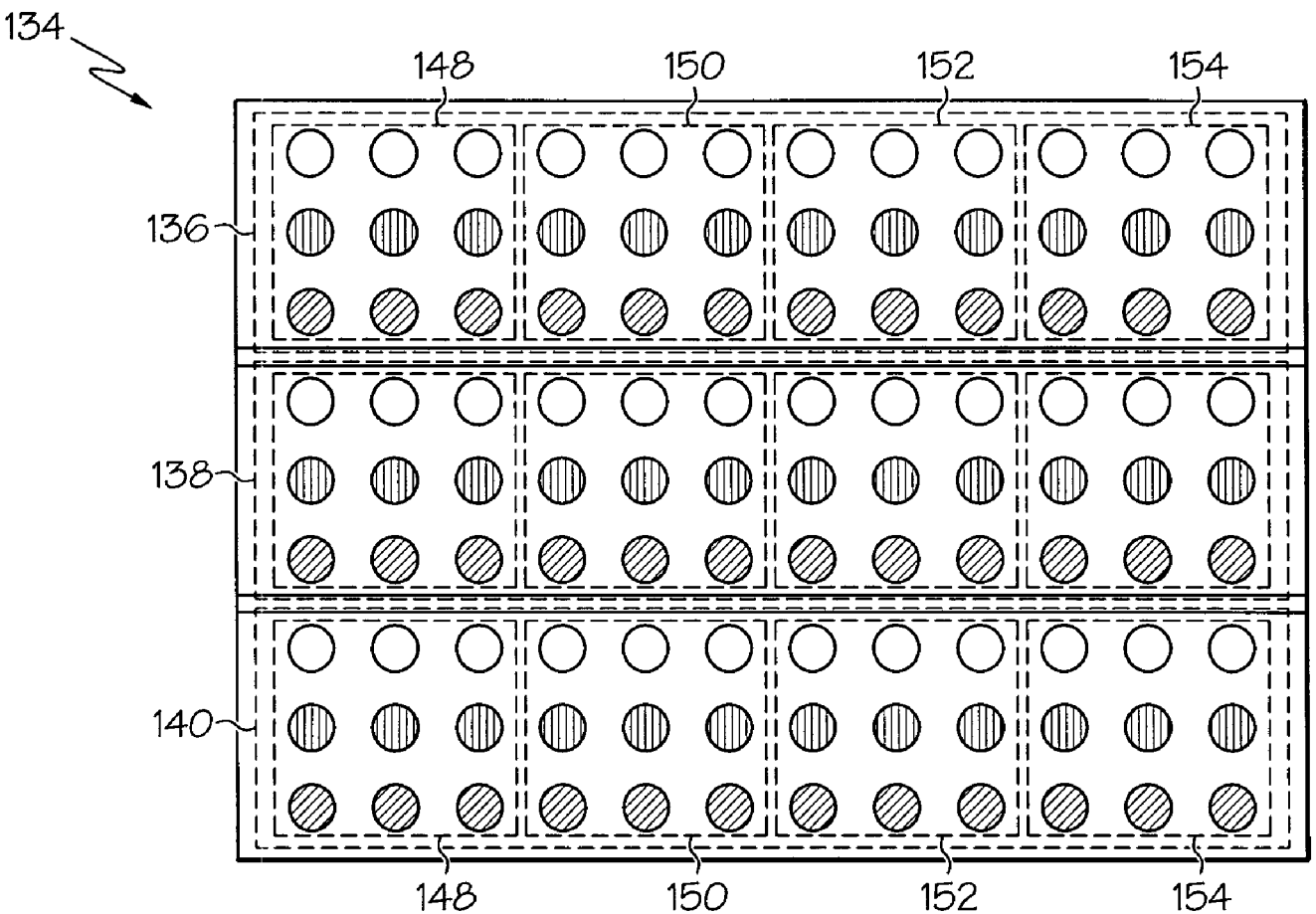
FIG. 12 is a plan view of a backlight for use in conjunction with the LCD panel of FIG. 11.

FIGS. 11 and 12 illustrate a LCD panel 132 and a backlight 134, respectively, according to another embodiment of the present invention. It should be noted that the pixels on the LCD panel 132 are not shown for illustrative clarity. Similar to that shown in FIGS. 9 and 10, the embodiment of FIGS. 11 and 12 uses multiple, independently controllable backlight zones 136, 138, and 140 that correspond, respectively, to sections 142, 144, and 146 of the LCD panel 132. Each zone 136, 138, and 140 of the backlight 134 includes four independently controllable regions (or backlight portions) 148, 150, 152, and 154, the boundaries of which are shown in both FIGS. 11 and 12. As shown, the regions 148, 150, 152, and 154 of each of the backlight zones 136, 138, and 140 may be aligned with one of the sections 142, 144, and 146 of the LCD panel 132. In this embodiment, as with the embodiment shown in FIGS. 9 and 10, the backlight zones 136, 138, and 140 are arranged to be perpendicular to the row scan direction (i.e., parallel to the gate lines 34 in the LCD panel 12 in FIG. 2). Further, the R, G, B luminance values in each of the regions 148-154 in each zone 136-140 is individually controllable as the backlight zones are scanned for a FSC LCD with the adjustable pulse width mode of operation.

With respect to construction, the LCD panel 132, may be similar to the one used in the previous embodiments. As with the embodiment shown in FIGS. 9 and 10, the number of zones 136-140 is defined by the time boundaries during the row scanning (or frame refreshing) process. At the boundaries for each zone 136-140, the backlight operation is adjusted to maintain color synchronization with the LCD data. The various regions of the LCD are illuminated by the corresponding regions of the backlight 134 with independent R, G, B luminance control. In actual operation, the RGB luminance values of each of the regions 148-154 in each of the zones 136-140 in the backlight 134 are computed from the image data to be presented in the LCD. Using the adjustable pulse width method described above, the LED backlight regions 148-154 corresponding to brighter regions of the image (in the image data) are driven to higher luminance levels, and the LED backlight regions 148-154 corresponding to darker regions in the image data are driven to lower luminance levels. As a result, LCD off-axis light leakage is dramatically reduced for the low-graylevel pixels, and display contrast ratio is enhanced over broad viewing angles. Thus, the image quality of the display is improved.

The RGB luminance values for each region 148-154 of the LED backlight 134 are calculated from the image data to be displayed. In essence, the LED backlight 134 shown in FIG. 12 may be driven as a very low resolution display (e.g., with each of the twelve regions 148-154 corresponding to a "pixel") using the drive voltages computed from the image data to be displayed on the LCD. While FIGS. 11 and 12 show a display with three zones 136-140 and four regions 48-154 in each zone, the display may indeed be separated in to more or less zones and each zone in turn may be divided in to more or less independently controllable backlight regions. An additional advantage of this embodiment is that it allows for further power savings during display operation.

Other embodiments may utilize different numbers and arrangements of light sources (e.g. LEDs). The numbers and arrangements, along with the sizes and shapes of the LEDs may be varied. For example, the numbers of particular colors, such as blue, may be adjusted to adjust the luminance of that particular color such that pulse widths may be varied over a greater range. Additionally, the overall size and shape of the LCD panel (or other image source) used may be varied. For example, a LCD panel with a substantially rectangular shape may have a length of between 3 and 15 inches and a width of between 1.5 and 12 inches.

Figure 13:
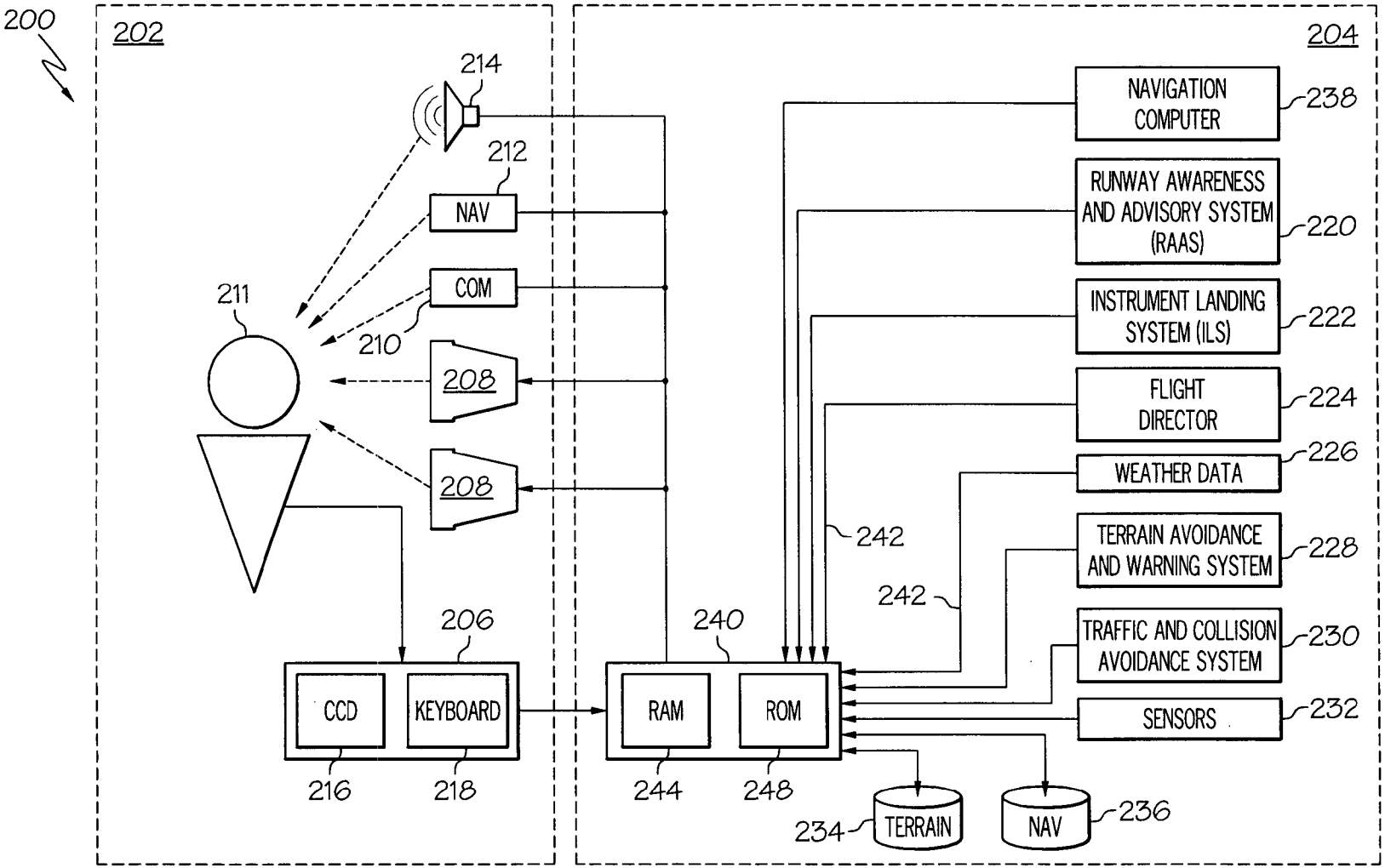
FIG. 13 is a schematic block diagram of a vehicle in which the display system of FIG. 1 may be implemented.

FIG. 13 schematically illustrates a vehicle 200, such as an aircraft, in which the display system 10 (FIG. 1) described above may be implemented, according to one embodiment of the present invention. The vehicle 200 may be, in one embodiment, any one of a number of different types of aircraft such as, for example, a private propeller or jet engine driven airplane, a commercial jet liner, or a helicopter. In the depicted embodiment, the vehicle 200 includes a flight deck 202 (or cockpit) and an avionics/flight system 204. Although not specifically illustrated, it should be understood that the vehicle 200 also includes a frame or body to which the flight deck 202 and the avionics/flight system 204 are connected, as is commonly understood. It should also be noted that vehicle 200 is merely exemplary and could be implemented without one or more of the depicted components, systems, and data sources. It will additionally be appreciated that the vehicle 200 could be implemented with one or more additional components, systems, or data sources. Additionally, is should be understood that the system 10 may be utilized in vehicles other than aircraft, such as manned ground vehicles with a closed cockpits (e.g. tank or armored personnel carrier) or an open vehicles such as a Humvee class vehicle. Further, the display system 10 may be used in portable computing devices such as laptop computers and other similar mobile devices with LCD displays.

The flight deck 202 includes a user interface 206, display devices 208 (e.g., a primary flight display (PFD)), a communications radio 210, a navigational radio 212, and an audio device 214. The user interface 206 is configured to receive input from the user 211 (e.g., the pilot) and, in response to the user input, supply command signals to the avionics/flight system 204. The user interface 206 may include flight controls and any one of, or combination of, various known user interface devices including, but not limited to, a cursor control device (CCD), such as a mouse, a trackball, or joystick, and/or a keyboard, one or more buttons, switches, or knobs. In the depicted embodiment, the user interface 206 includes a CCD 216 and a keyboard 218. The user 211 uses the CCD 216 to, among other things, move a cursor symbol on the display devices 208, and may use the keyboard 218 to, among other things, input textual data.

Still referring to FIG. 1, the display devices 208, which may include the flat panel display system described above, are used to display various images and data, in graphic, iconic, and/or textual formats, and to supply visual feedback to the user 211 in response to user input commands supplied by the user 211 to the user interface 206.

The communication radio 210 is used, as is commonly understood, to communicate with entities outside the vehicle 200, such as air-traffic controllers and pilots of other aircraft. The navigational radio 212 is used to receive from outside sources and communicate to the user various types of information regarding the location of the vehicle, such as Global Positioning Satellite (GPS) system and Automatic Direction Finder (ADF) (as described below). The audio device 214 is, in one embodiment, an audio speaker mounted within the flight deck 202.

The avionics/flight system 204 includes a runway awareness and advisory system (RAAS) 220, an instrument landing system (ILS) 222, a flight director 224, a weather data source 226, a terrain avoidance warning system (TAWS) 228, a traffic and collision avoidance system (TCAS) 230, a plurality of sensors 232 (e.g., a barometric pressure sensor, a thermometer, and a wind speed sensor), one or more terrain databases 234, one or more navigation databases 236, a navigation and control system (or navigation computer) 238, and a processor 240. The various components of the avionics/flight system 204 are in operable communication via a data bus 242 (or avionics bus). Although not illustrated, the navigation and control system 238 may include a flight management system (FMS), a control display unit (CDU), an autopilot or automated guidance system, multiple flight control surfaces (e.g., ailerons, elevators, and a rudder), an Air Data Computer (ADC), an altimeter, an Air Data System (ADS), a Global Positioning Satellite (GPS) system, an automatic direction finder (ADF), a compass, at least one engine, and gear (i.e., landing gear).

The processor 240 may be any one of numerous known general-purpose microprocessors or an application specific processor that operates in response to program instructions. In the depicted embodiment, the processor 240 includes on-board RAM (random access memory) 244 and on-board ROM (read only memory) 246. The program instructions that control the processor 240 may be stored in either or both the RAM 244 and the ROM 246. For example, the operating system software may be stored in the ROM 246, whereas various operating mode software routines and various operational parameters may be stored in the RAM 244. It will be appreciated that this is merely exemplary of one scheme for storing operating system software and software routines, and that various other storage schemes may be implemented. It will also be appreciated that the processor 240 may be implemented using various other circuits, not just a programmable processor. For example, digital logic circuits and analog signal processing circuits could also be used.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A method for displaying an image on a display device having first and second light sources, the method comprising:

providing a video signal to the display device, the video signal comprising first and second video frames, each video frame comprising first and second sub-frames corresponding to the respective first and second light sources, the first and second sub-frames having adjustable on-times, and thus adjustable pulse-widths, for the first and second light sources;

operating the first light source during the first sub-frame of the first video frame to generate a first plurality of first light emission pulses, each of the first plurality of first light emission pulses having a first on-time and thus a first pulse-width, the first pulse-width equal to a minimum pulse-width, a maximum pulse-width, or a pulse-width between the minimum pulse-width and the maximum pulse-width;

operating the first light source during the first sub-frame of the second video frame to generate a second plurality of first light emission pulses, each of the second plurality of first light emission pulses having a second on-time and thus a second pulse-width, the second pulse-width equal to the minimum pulse-width, the maximum pulse-width, or a pulse-width between the minimum pulse-width and the maximum pulse-width, the second on-time being different from the first on-time, whereby the second pulse-width is different from the first pulse-width;

supplying a constant peak current to the first light source at least when the first pulse-width and the second pulse-width are equal to a pulse-width between the minimum pulse-width and the maximum pulse-width, wherein the difference in the first pulse-width and the second pulse-width varies the brightness of the first light source; and selectively varying the peak current supplied to the first light source when either the first pulse-width or the second pulse-width is not equal to a pulse-width between the minimum pulse-width and the maximum pulse-width, to thereby further vary the brightness of the first light source.

2. The method of claim 1, further comprising:

operating the second light source during the second sub-frame of the first video frame to generate a first plurality of second light emission pulses, each of the first plurality of second light emission pulses having a third on-time and thus a third pulse-width; and operating the second light source during the second sub-frame of the second video frame to generate a second plurality of second light emission pulses, each of the second plurality of second light emission pulses having a fourth on-time and thus a fourth pulse-width.

3. The method of claim 2, wherein the first light source emits light within a first frequency band and the second light source emits light within a second frequency band, the second frequency band being different from the first frequency band.

4. The method of claim 3, further comprising generating an image with the light emitted from the first and second light sources with an image source based on the video signal.

5. The method of claim 4, wherein the third on-time and thus the third pulse-width are the same as the first on-time and thus the first pulse-width, respectively.

6. The method of claim 5, wherein the fourth on-time and thus the fourth pulse-width are the same as the second on-time and thus the second pulse-width, respectively.

7. The method of claim 4, wherein the third on-time and thus the third pulse-width are different from the first on-time and thus the first pulse-width, respectively, and the fourth on-time and thus the fourth pulse-width are different from the second on-time and thus the second pulse-width, respectively.

8. The method of claim 4, wherein the display device comprises a third light source and each video frame of the video signal comprises a third sub-frame corresponding to the third light source, and further comprising:

operating the third light source during the third sub-frame of the first video frame to generate a first plurality of third light emission pulses, each of the first plurality of third light emission pulses having a fifth on-time and a fifth pulse-width; and operating the third light source during the third sub-frame of the second video frame to generate a second plurality of third light emission pulses, each of the second plurality of third light emission pulses having a sixth on-time and thus a sixth pulse-width.

9. The method of claim 8, wherein the first, second, and third light sources comprise respective first, second, and third pluralities of light emitters, the image source comprises a plurality of pixels, and said generation of the image with the image source comprises configuring the plurality of pixels.

10. The method of claim 9, further comprising adjusting the first, second, third, fourth, fifth, and sixth on-times and thus the first, second, third, fourth, fifth, and sixth pulse-widths based on usage of the respective pluralities of light emitters, a temperature on the display device, or a combination thereof.

11. A method for displaying an image on a display device having first and second pluralities of light emitters and an imaging source:

providing a video signal to the display device, the video signal comprising first and second video frames, each video frame comprising first and second sub-frames corresponding to the respective first and second pluralities of light emitters, the first and second sub-frames having adjustable on-times, and thus adjustable pulse-widths, for the first and second light sources;

operating the first plurality of light emitters during the first sub-frame of the first video frame to generate a first plurality of first light emission pulses, each of the first plurality of first light emission pulses having a first on-time and thus a first pulse-width, the first pulse-width equal to a minimum pulse-width, a maximum pulse-width, or a pulse-width between the minimum pulse-width and the maximum pulse-width;

operating the first plurality of light emitters during the first sub-frame of the second video frame to generate a second plurality of first light emission pulses, each of the second plurality of first light emission pulses having a second on-time and thus a second pulse-width, the second pulse-width equal to the minimum pulse-width, the maximum pulse-width, or a pulse-width between the minimum pulse-width and the maximum pulse-width, the second on-time being different from the first on-time, whereby the second pulse-width is different from the first pulse-width;

operating the second plurality of light emitters during the second sub-frame of the first video frame to generate a first plurality of second light emission pulses, each of the first plurality of second light emission pulses having a third on-time and thus a third pulse-width, the third pulse-width equal to the minimum pulse-width, the maximum pulse-width, or a pulse-width between the minimum pulse-width and the maximum pulse-width;

operating the second plurality of light emitters during the second sub-frame of the second video frame to generate a second plurality of second light emission pulses, each of the second plurality of second light emission pulses having a fourth on-time and thus a fourth pulse-width, the fourth pulse-width equal to the minimum pulse-width, the maximum pulse-width, or a pulse-width between the minimum pulse-width and the maximum pulse-width, the fourth on-time being different from the third on-time, whereby the fourth pulse-width is different from the third pulse-width;

supplying a constant peak current to the first plurality of light emitters at least when the first pulse-width and the second pulse-width are equal to a pulse-width between the minimum pulse-width and the maximum pulse-width, wherein the difference in the first-pulse-width and the second pulse-width varies the brightness of the first plurality of light emitters;

selectively varying the peak current supplied to the first plurality of light emitters when either the first pulse-width or the second pulse-width is not equal to a pulse-width between the minimum pulse-width and the maximum pulse-width, to thereby further vary the brightness of the first plurality of light emitters;

supplying a constant peak current to the second plurality of light emitters at least when the third pulse-width or the fourth pulse-width are equal to a pulse-width between the minimum pulse-width and the maximum pulse-width, wherein the difference in the third-pulse-width and the fourth pulse-width varies the brightness of the second plurality of light emitters;

selectively varying the peak current supplied to the second plurality of light emitters when either the third pulse-width or the fourth pulse-width is not equal to a pulse-width between the minimum pulse-width and the maximum pulse-width, to thereby further vary the brightness of the second plurality of light emitters; and generating an image with the light emitted from the first and second pluralities of light emitters during the respective first and second on-times with the imaging device.

12. The method of claim 11, wherein the display device further comprises a third plurality of light emitters and each video frame further comprises a third sub-frame corresponding to the third plurality of light emitters, and further comprising:

operating the third plurality of light emitters during the third sub-frame of the first video frame to generate a first plurality of third light emission pulses, each of the first plurality of third light emission pulses having a fifth on-time and thus a fifth pulse-width; and operating the third plurality of light emitters during the third sub-frame of the second video frame to generate a second plurality of third light emission pulses, each of the second plurality of third light emission pulses having a sixth on-time and thus a sixth pulse-width, the sixth on-time being different from the fifth on-time, whereby the sixth pulse-width is different from the fifth pulse-width.

13. The method of claim 12, further comprising adjusting the first, second, third, fourth, fifth, and sixth on-times, and thus the first, second, third, fourth, fifth, and sixth pulse-widths, based on usage of the respective pluralities of light emitters, a temperature on the display device, or a combination thereof.

14. The method of claim 13, wherein the first, third, and fifth on-times, and thus the first, third, and fifth pulse-widths are the same, and the second, fourth, and sixth on-times, and thus the second, fourth, and sixth pulse-widths, are the same.

15. The method of claim 14, wherein the first, third, and fifth on-times, and thus the first, third, and fifth pulse-widths, are different, and the second, fourth, and sixth on-times, and thus the second fourth, and sixth pulse-widths, are different.

16. A display device system comprising:

a backlight comprising first and second light emitters;

an image source coupled to the backlight and configured to generate an image with light emitted from the first and second light emitters; and a controller coupled to the backlight and the image source, the controller being configured to:

provide a video signal to the backlight and the image source, the video signal comprising first and second video frames, each video frame comprising first and second sub-frames corresponding to the respective first and second light emitters of the backlight, the first and second sub-frames having adjustable on-times for the first and second light sources;

operate the first light emitter during the first sub-frame of the first video frame to generate a first plurality of first light emission pulses, each of the first plurality of first light emission pulses having a first on-time and thus a first pulse-width, the first pulse-width equal to a minimum pulse-width, a maximum pulse-width, or a pulse-width between the minimum pulse-width and the maximum pulse-width;

operate the first light emitter during the first sub-frame of the second video frame to generate a second plurality of first light emission pulses, each of the second plurality of first light emission pulses having a second on-time and thus a second pulse-width, the second pulse-width equal to the minimum pulse-width, the maximum pulse-width, or a pulse-width between the minimum pulse-width and the maximum pulse-width, the second on-time being different from the first on-time, whereby the second pulse-width is different from the first pulse-width;

supply a constant peak current to the first light emitter at least when the first pulse-width and the second pulse-width are equal to a pulse-width between the minimum pulse-width and the maximum pulse-width, wherein the difference in the first pulse-width and the second pulse-width varies the brightness of the first light emitter; and selectively vary the peak current supplied to the first light emitter when either the first pulse-width or the second pulse-width is not equal to a pulse-width between the minimum pulse-width and the maximum pulse-width, to thereby further vary the brightness of the first light source.

17. The system of claim 16, wherein the controller is further configured to:

operate the second light source during the second sub-frame of the first video frame to generate a first plurality of second light emission pulses, each of the first plurality of second light emission pulses having a third on-time and thus a third pulse-width; and operate the second light source during the second sub-frame of the second video frame to generate a second plurality of second light emission pulses, each of the second plurality of second light emission pulses having a fourth on-time and thus a fourth pulse-width, the fourth on-time being different from the third on-time, whereby the fourth pulse-width is different from the third pulse-width.

18. The system of claim 17, wherein the backlight further comprises a third light emitter and each video frame of the video signal further comprises a third sub-frame corresponding to the third light emitter, and wherein the controller is further configured to:

operate the third light source during the third sub-frame of the first video frame to generate a first plurality of third light emission pulses, each of the first plurality of third light emission pulses having a fifth on-time and thus a fifth pulse-width; and operate the third light source during the third sub-frame of the second video frame to generate a second plurality of third light emission pulses, each of the second plurality of third light emission pulses having a sixth on-time and thus a sixth pulse-width, the sixth on-time being different from the fifth on-time, whereby the sixth pulse-width is different from the fifth pulse-width.

19. The system of claim 18, wherein at least some of the first, second, and third light emitters are light emitting diodes and wherein the image source is a liquid crystal display comprising a plurality of pixels.

20. The system of claim 19, further comprising a temperature sensor coupled to the backlight and configured to generate a signal representative of a temperature of the backlight and a photopic color sensor coupled to the backlight and configured to generate a signal representative of the luminance of the light emitters, and wherein the controller is further configured to adjust the first, second, third, fourth, fifth, and sixth on-times, and thus the first, second, third, fourth, fifth, and sixth pulse-widths, based on usage of the respective pluralities of light emitters, a temperature on the display device, or a combination thereof.

* * * * *